US005316465A

United States Patent [19]

Hummel

[11] Patent Number: 5,316,465

[45] Date of Patent: May 31, 1994

[54] APPARATUS FOR PROVIDING RANDOM RAKE FINISH IN A CAST CONCRETE SURFACE

[75] Inventor: Robert A. Hummel, Clifton, Va.

[73] Assignee: The Reinforced Earth Company, Vienna, Va.

[21] Appl. No.: 934,354

[22] Filed: Aug. 21, 1992

[51] Int. Cl.[5] ..... B28B 11/08

[52] U.S. Cl. ..... 425/343; 264/293; 425/385

[58] Field of Search ..... 264/69, 70, 74, 162, 264/284, 293, 296; 425/218, 296, 297, 343, 324.1, 385, 429, 431, 456, 457, 469, 470, 472

[56] References Cited

U.S. PATENT DOCUMENTS

| | | | |
|---|---|---|---|
| 1,179,792 | 4/1916 | Ballou | 425/385 |
| 1,202,252 | 10/1916 | Varney | 425/385 |
| 1,220,807 | 3/1917 | Wolfe | 425/385 |
| 1,272,533 | 7/1918 | Robinson | 425/385 |
| 1,631,220 | 6/1927 | Nicholson | 425/385 |
| 1,809,572 | 6/1931 | Smith | 264/284 |
| 1,854,788 | 4/1932 | Fenati | 425/385 |
| 2,193,916 | 3/1940 | Bentley et al. | 425/385 |
| 3,775,529 | 11/1973 | Steenson et al. | 425/385 |
| 4,050,864 | 9/1977 | Komaki | 425/449 |

OTHER PUBLICATIONS

New Jersey Department of Transportation Special Provisions, Regulations and Contract Regulations.

*Primary Examiner*—Jay H. Woo
*Assistant Examiner*—James P. Mackey
*Attorney, Agent, or Firm*—Allegretti & Witcoff, Ltd.

[57] ABSTRACT

Apparatus for mechanically forming a random rake finish on the surface of a cast panel utilizes counter rotating sets of tines which are projected into the material as a form is linearly moved. The apparatus thus is used to implement a unique method of providing a random rake or fuzzy finish on the surface of the cast panel.

3 Claims, 4 Drawing Sheets

APPARATUS FOR PROVIDING RANDOM RAKE FINISH IN A CAST CONCRETE SURFACE

BACKGROUND OF THE INVENTION

This invention relates to an improved method and apparatus for providing a random rake finish in the surface of a cast concrete panel.

With the advent of multiple lane, limited access highways for motor vehicles, there has been a growing concern, particularly in urban areas, with respect to the noise generated by traffic on the roadway. Various solutions have been proposed to diminish the noise including the erection of various types and kinds of barriers between the roadway and the area adjacent the roadway. These barriers have been constructed from numerous types of materials including wood, concrete and metallic screen. One of the more popular and useful types of materials used to create such barriers is concrete typically in the form of a cast concrete panel or in the form of layers of concrete and other materials in a panel that is able to withstand weathering yet which provides required sound deadening characteristics, structural integrity and is economical to manufacture, install and service. Originally such cast concrete panels had smooth surfaces. Over time the texture of the surfaces has changed, and the materials used on the surfaces have changed. Thus the esthetic quality of the surfaces has been enhanced by texture, color and otherwise.

One of the popular surface textures associated with precast concrete panels used for traffic barriers is known as the random rake surface finish. That is, a concrete panel is cast in a particular shape and size. Typically, the material being cast includes an aggregate which is maintained in a smooth and fluid cement mixture. After the panel is cast in the desired thickness and shape, and a smooth generally flat uniform surface has been achieved, the surface is textured to a rough or "fuzzy" finish. This finish is produced by use of an asphalt rake, typically a 24" asphalt rake, having every other tine removed therefrom. The rake is manually manipulated by dragging the tines in the surface or outer face of the cast panel. The tines are required to project about 1" below the surface of the panel, and they are moved in a swirling motion in a manner so that the surface will not be gouged and so that tine marks will not be left in the surface. This causes the aggregate in the panel to be randomly distributed and projected from the surface of the panel to provide the desired finish. This finish is thus provided by a random series of projections of the aggregate from the panel surface. After the raking operation is completed the concrete is then allowed to dry normally.

The particular procedure by which such panels are manufactured is exceedingly labor intensive and thus quite costly. Additionally, the variants in finish resulting from the "raking" techniques of individual laborers may become apparent. Thus there may not be a uniform random raking operation performed on the surfaces and the panels will look dissimilar. This is an undesired outcome.

Therefore, there has developed a need to provide a procedure and a mechanism by which a random rake finish can be produced which is uniform, inexpensive, reproducible and not as labor intensive as prior procedures.

SUMMARY OF THE INVENTION

The present invention provides a method and apparatus for mechanically forming a random rake finish in the surface of the cast material panel. The cast material typically includes an aggregate which is formulated as part of a hardenable fluid so as to generally define a planar surface. The aggregate material thus cooperates with a bonding material and together they form a hardenable mass. As a first step, the aggregate and bonding material are poured into a frame or form. The material is generally smoothed to define a flat surface, and then a series of spaced tines are projected into that surface. The tines are extended below the surface while simultaneously being moved in arcuate loops in the material and further the tines are moved transversely in a generally linear direction across the surface. The described movement of the tines is effected over the entire surface of the material always engaging the material and, in particular, agitating the aggregate to form the random rake finish. Thereafter the tines are removed from contact with the material and the material is permitted to harden to thereby fix the random rake finish in the surface.

The apparatus for accomplishing this method is comprised of a conveyor which supports the hardenable fluid material in a mold or form. An arm positioned over the conveyor supports a tine support bar over the surface of the material and supports said bar in a manner which permits rotation of the tines mounted on the bar. Multiple spaced tines project from the support bar and are moved into or withdrawn from the cast material by a mechanism for projecting or withdrawing the tines. Means are also provided to rotate the tines relative to the surface of the cast material in such a manner that the tines are movable in arcuate or circular loops. The tines are also movable in a linear direction relative to the surface typically by movement of the form on the conveyor. Alternatively, the tines are moved in a linear direction relative to the form.

Thus, there is provided by means of the method and apparatus of the invention an improved method for manufacture of a random rake finish in a cast panel. The random rake finish is also known as a popcorn or fuzzy rake finish.

It is a further object of the invention to provide a mechanism and method for manufacture of panels having a random rake finish which is much less labor intensive and much more cost effective than prior art methods and apparatus.

A further object of the invention is to provide a method for manufacture of a random rake finish surface on a panel wherein the finish is reproducible.

Yet another object of the invention is to provide a method for manufacture of a random rake finish in the surface of a precast panel wherein panels of various size and shape may be manufactured in accordance with the method and further may be manufactured by means of the apparatus of the invention.

These and other objects, advantages and features of the invention will be set forth in the detailed description which follows.

BRIEF DESCRIPTION OF THE DRAWING

In the detailed description which follows, reference will be made to the drawing comprised of the following Figures.

DESCRIPTION OF THE PREFERRED EMBODIMENT

Figure 1:
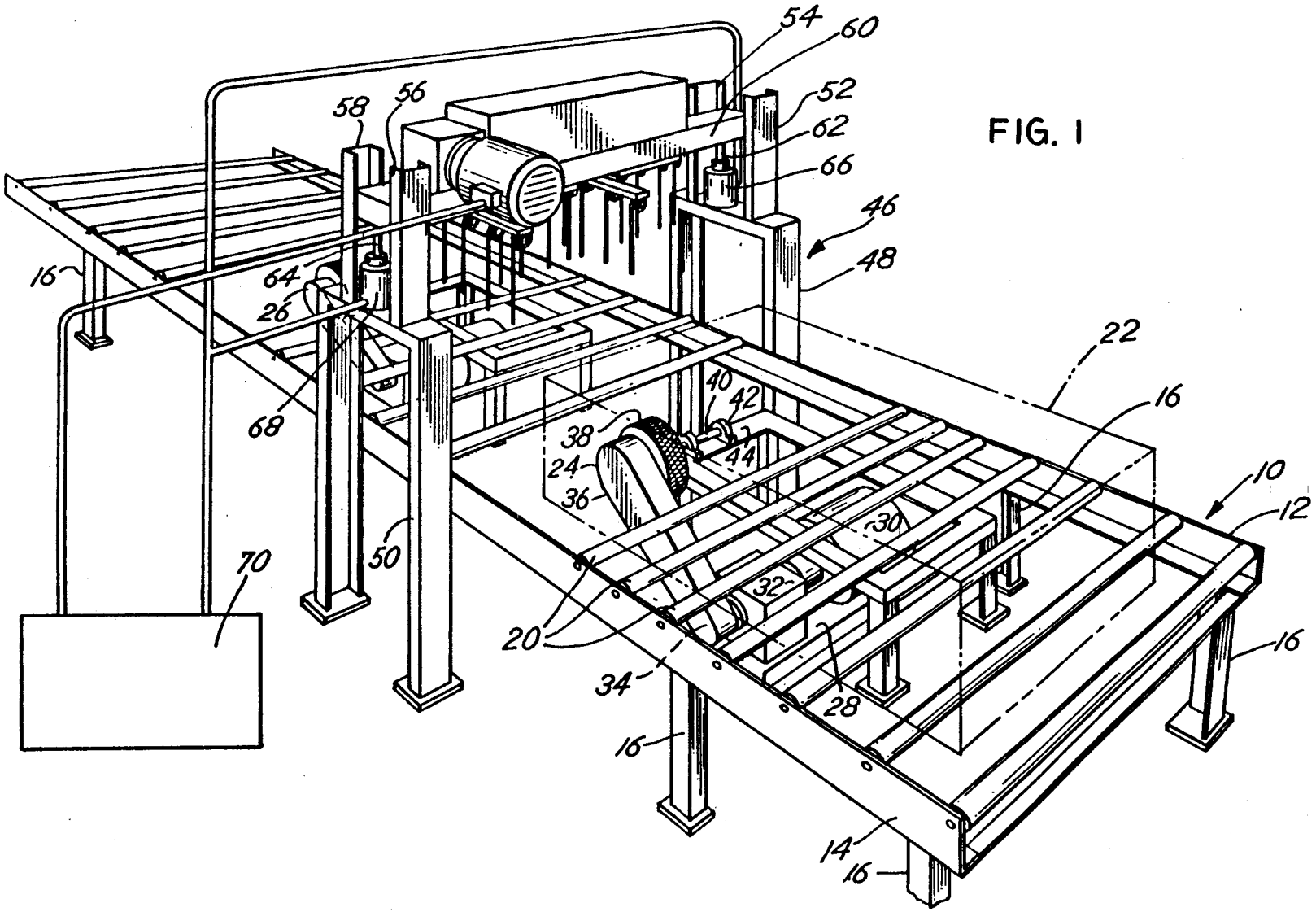
FIG. 1 is a perspective view of the apparatus of the invention which may be utilized and employed to practice the method of the invention.
Figure 2:
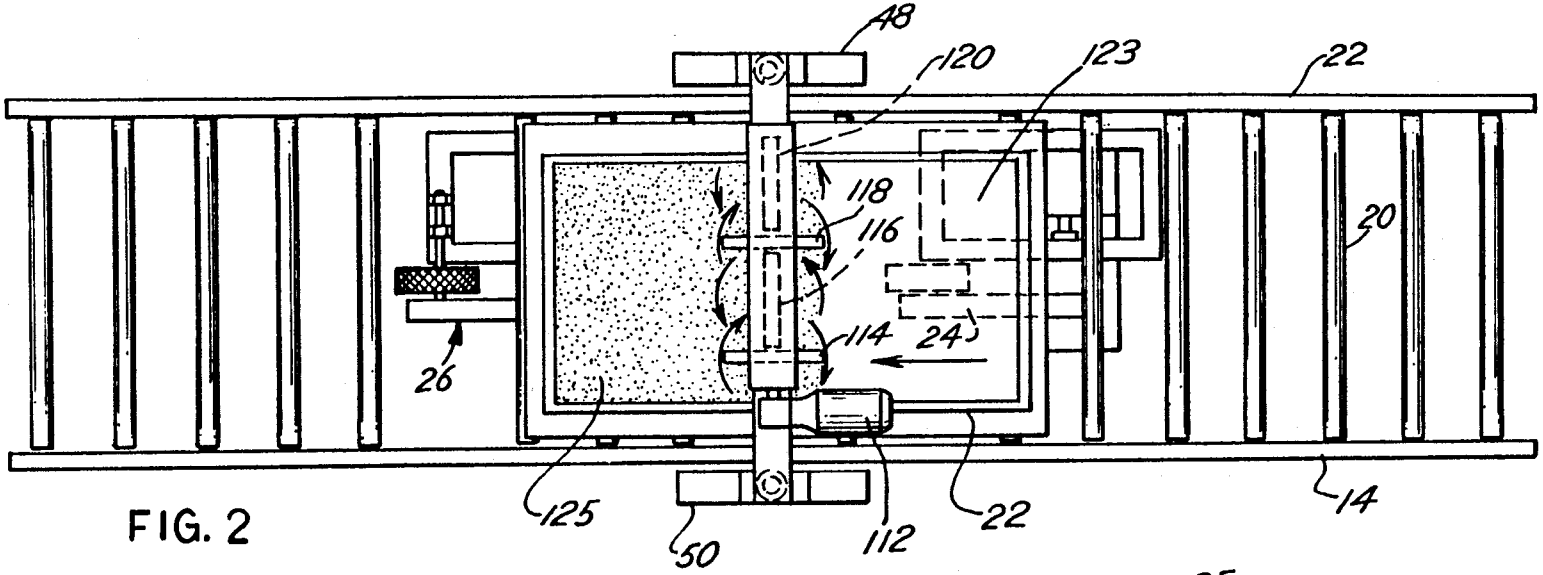
FIG. 2 is a top plan view of the apparatus of FIG. 1 further depicting the method of the invention.
Figure 3:
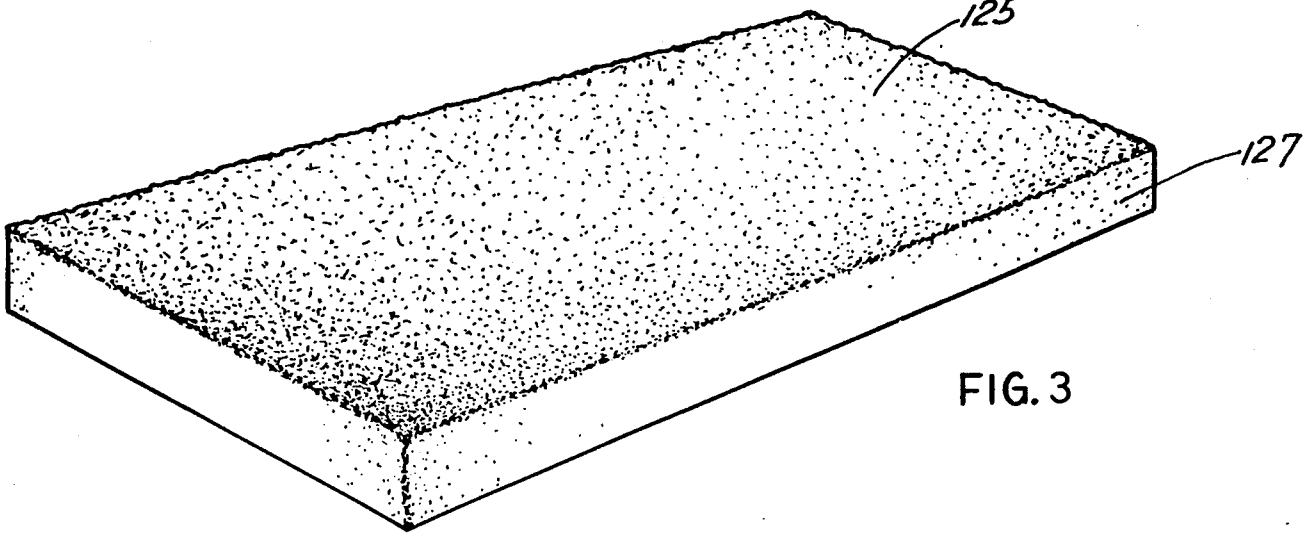
FIG. 3 is a perspective view of a panel constructed in accordance with the method of the invention by the apparatus of the invention.
Figure 4:
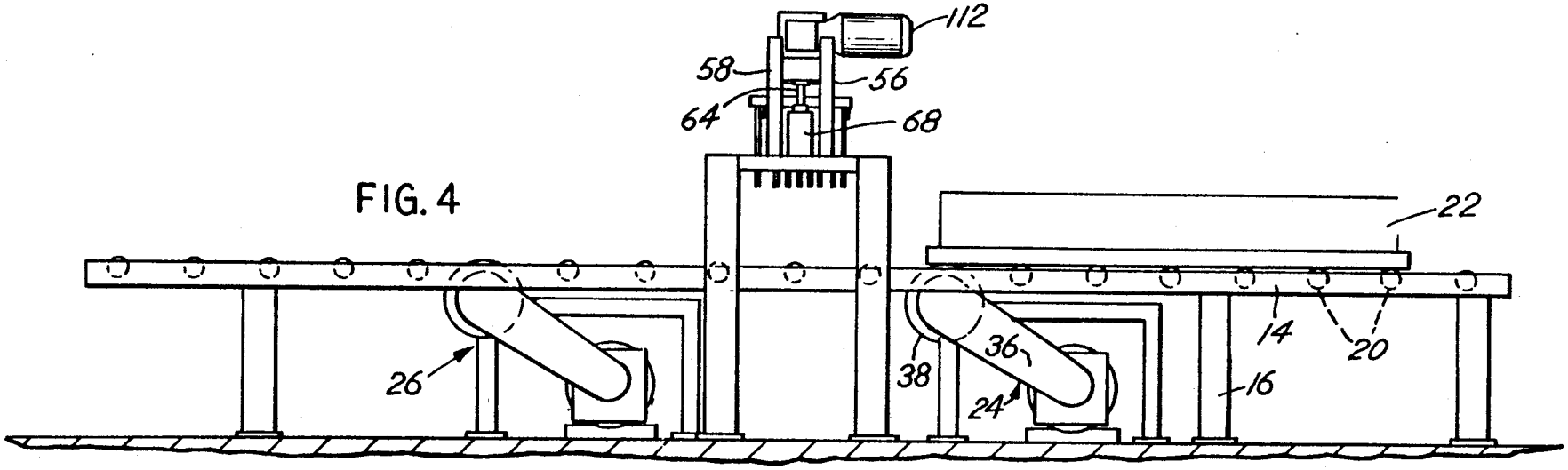
FIG. 4 is a side elevation of the apparatus of FIG. 1.
Figure 5:
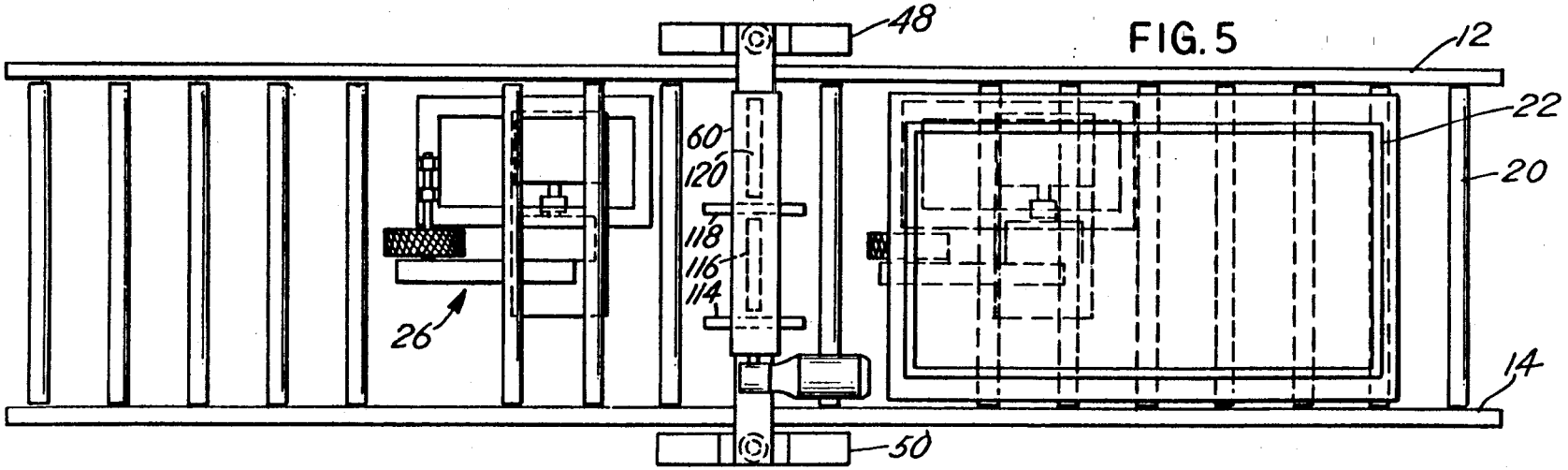
FIG. 5 is a further top plan view of the apparatus of the invention.

The Figures depict an apparatus which is useful in performing the method of manufacture of a panel having a random rake finish on its one surface. Thus, there follows a description of the preferred embodiment of the apparatus. Thereafter a description of the methodology employed using the described apparatus is set forth. Other apparatus may be utilized to perform the described methodology and therefore the apparatus described is not a limiting feature of the invention. Further, other apparatus may be utilized to manufacture panels having a random rake surface wherein the panels have different configurations and shapes than the panel shape and form depicted in the specification and drawing.

THE APPARATUS

Referring especially to FIGS. 1-4 and 5, the apparatus incorporates a conveyor 10 comprised of a frame made up of side rails 12 and 14 supported on legs 16. The side rails 12 and 14 are interconnected by cross-members such as cross-members 18 to define a rigid support frame. Rollers 20 are arranged at spaced intervals extending between the side rails 12 and 14. The rollers 20 support a mold or form which is shown in phantom in FIG. 1 as form 22. The form 22 receives the fluid material which defines the panel, e.g. mixture of cement and aggregate.

Positioned beneath the conveyor 10 are first and second form driving assemblies 24 and 26. Each assembly 24 and 26 has substantially the identical construction and thus the following description with respect to assembly 24 is equally applicable to assembly 26. The assembly 24 is mounted on a platform 28. The platform 28 supports a motor 30 which has an output or drive shaft that acts through a gear box 32 and connects to a drive chain 34 mounted within a housing 36 for driving a friction wheel 38. The wheel 38 is supported on an axle 40 journaled in bearings 42 supported on a frame 44. The axle 40 supports the wheel 38 so that the outer surface of the wheel 38 may frictionally engage the lower or bottom surface of the form 22. Thus, as the wheel 38 is driven by the motor 30, the form 22 will be engaged and advanced along the conveyor 10 and more specifically over the rollers 20. Both assemblies 24 and 26 work in the described manner. Typically the wheel 38 associated with the assembly 24 is rotated at a constant speed so as to uniformly drive the form 22 along the conveyor 10.

A tine support frame 46 includes spaced brackets 48 and 50 positioned on opposite sides of the conveyor 10. The bracket 48 includes a pair of opposed vertically extending channel members 52 and 54. In a similar fashion the bracket 50 includes channel members 56 and 58 which are opposed to one another. Slidably positioned within each recess defined by the opposed channel members 52 and 54 and channel members 56 and 58 is a sliding cross-member 60. The cross-member 60 is maintained in horizontal position and is mounted on parallel, vertically extending rods 62 and 64 which project from cylinders 66 and 68 respectively. The rods 62 and 64 are responsive to actuation of the cylinders 66 and 68 which, in turn, are controlled by means of a control box mechanism 70 so as to raise or lower the cross-member 60. As described below, the cross-member 60 supports an assembly of tines which are raised and lowered vertically in response to actuation of cylinders 66 and 68.

Figure 6:
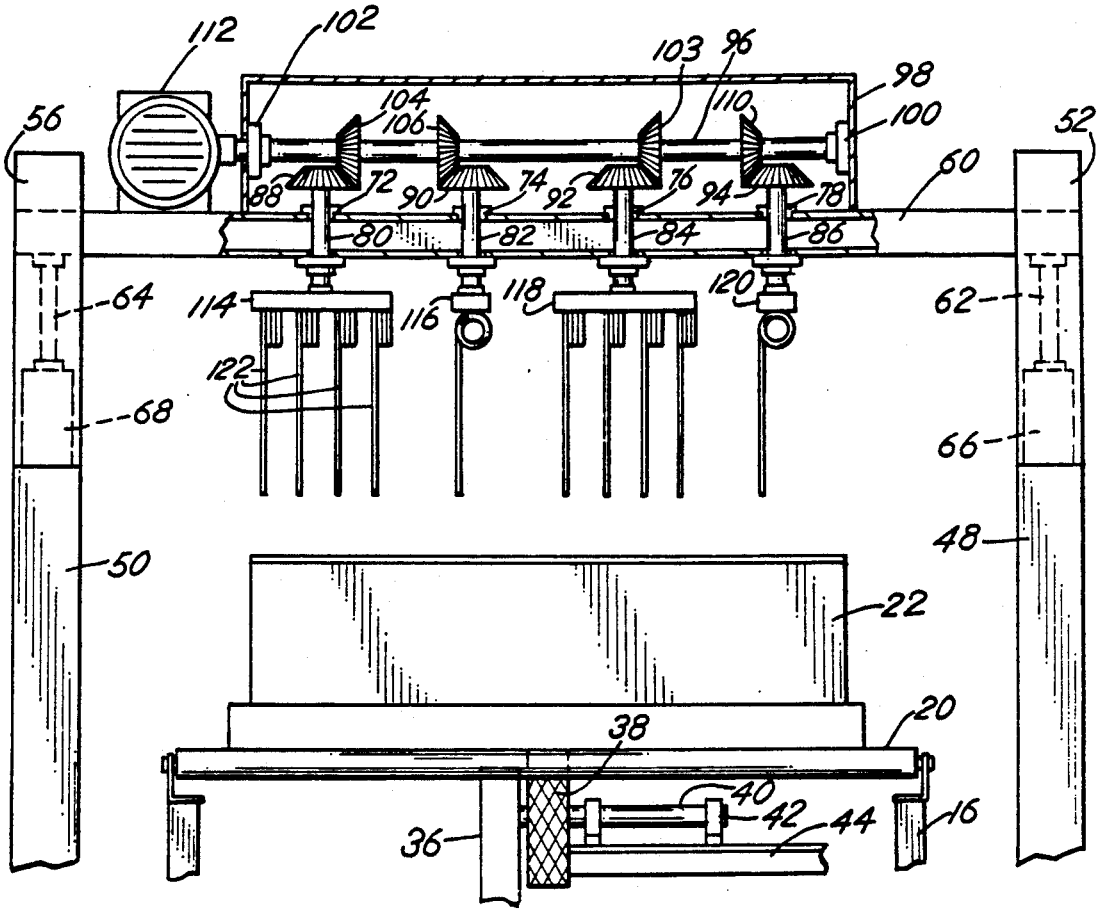
FIG. 6 is a partial end elevation of the apparatus of the invention depicting the arrangement of the random rake tines prior to entry into the material comprising the cast product.
Figure 7:
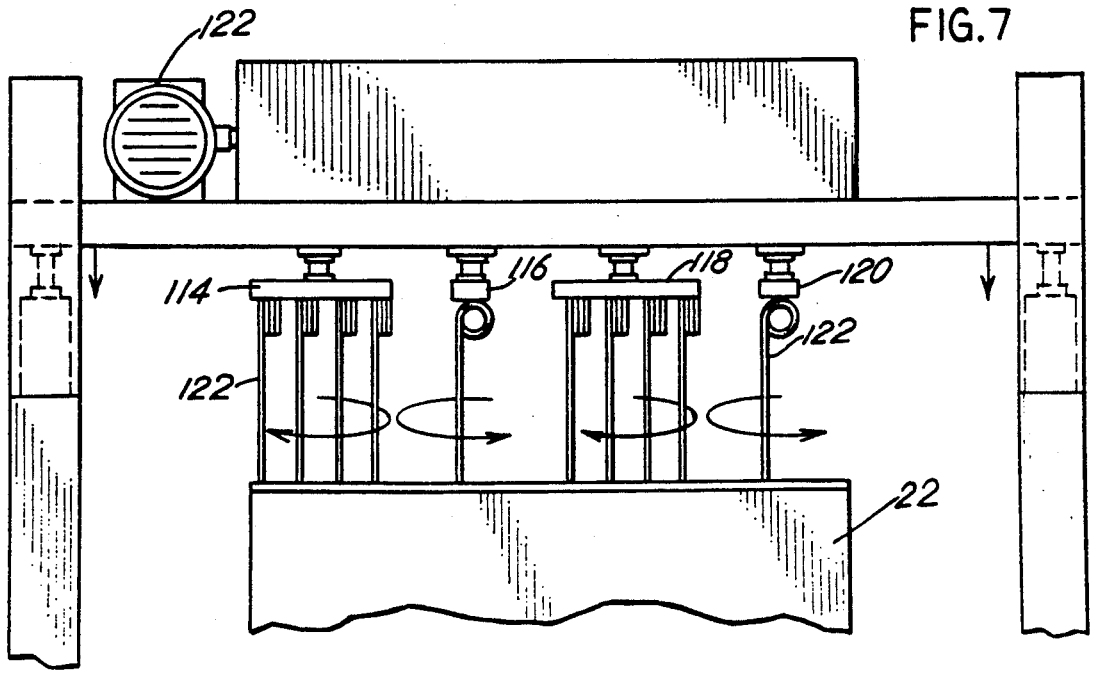
FIG. 7 is an end elevation similar to FIG. 6 wherein the tines have been positioned into the panel material and wherein the tines are being operated to effect the random rake finish.

Referring therefore to FIGS. 6 and 7, there is disclosed in greater detail the construction of the arrangement of tines mounted on the cross-member 60. Thus the cross-member or bar 60 includes a series of four equally spaced journalled openings 72, 74, 76 and 78. Journalled within each opening 72, 74, 76 and 78 is a rotatable shaft 80, 82, 84 and 86 respectively. A bevel gear 88, 90, 92 and 94 is attached to each shaft or axle 80, 82, 84 and 86 respectively. A separate drive shaft 96 is journalled into opposite ends of a support assembly 98 by means of journal bearings 100 and 102. The drive shaft 96 is arranged at a right angle to shafts 80, 82, 84, 86 and includes compatible bevel gears 104, 106, 108 and 110 which cooperate respectively with bevel gears 88, 90, 92 and 94. The shaft 96 is driven by a motor 112 which is mounted on the cross-member or bar 60.

Each of the shafts 80, 82, 84 and 86 supports a rotatable tine support bar 114, 116, 118 and 120. A plurality of four spaced tines 122 are mounted on each tine support bar 114, 116, 118, 120 and are spaced longitudinally along the length of each bar 114, 116, 118 and 120. The tines 122 are equally spaced. The tines are also arranged symmetrically with respect to the axis of rotation of the appropriate shaft 80, 82, 84 and 86. The tines 122 depend vertically downward at right angles to the direction of travel of form 22 on conveyor 10.

Note that the bevel gears 88, 104, 90, 106, 92, 108 and 94, 110 are arranged to drive the shafts 80, 82, 84 and 86 in counter-rotating directions relative to one another. It is for this reason that the gears 104, 106 are on opposite sides of the axis of rotation of shafts 80 and 82. Similarly, the bevel gears 108 and 110 are on opposite sides of the shafts 84, 86 respectively. The tines 122 are arranged on each of the bars 114, 116, 118, 120 in the manner described.

As shown in FIG. 7, the tines 122 are effectively lowered into the unhardened fluid material by operation of the cylinders 66 and 68 which lowers the bar 60. The motor 112 is operated to effect the counter-rotating motion of the tines 122 on the respective tine support bars 114, 116, 118 and 120. As the motor 112 is operating to effect counter rotation of the sets of tines 122, the drive wheels 38 are also operating, and the form drive assemblies 24 and 26 effect movement of the form 22 with the material being cast along the conveyor 10. The tines 122 thus effect an arcuate or circular pattern in the cast material and interact with the aggregate in the cast material.

METHOD OF OPERATION

In operation then, as a first step, a form 22 is placed on the conveyor 10. The form 22 is then filled with the material that is to be cast. The material is generally hardenable and includes an aggregate. The material may be layered, may be a composite, may include cement, but does include an aggregate. The material is smoothed to define a surface 123 in FIG. 2 which is generally level with the top of the form 22. The surface 123 is thus generally planar. The form 22 is next transported on the conveyor so that a leading end of the form 22 is positioned just below the tines 122. The cylinders 66 and 68 are then operated to lower the tines 122 to about one inch penetration into the surface. The extent of penetration will vary depending upon the aggregate and other materials used. Simultaneously, the motor 112 is actuated to cause the separate assemblies of tines 122 on each bar 114, 116, 118 and 120 to move in a counter rotational sense. That is bars 114 and 118 may move clockwise while bars 116 and 120 move counterclockwise. The form drive assemblies 24 and 26, by means of operation of the wheels 38, are then operated to drive the form 22 in a linear direction along the conveyor 10. This linear movement occurs as the tines 122 continue their counter-rotating motion.

Empirical operation of the assembly is most generally appropriate in order to determine the appropriate speeds of rotation of the tines as well as the speed of movement of the form 22 on the conveyor 10. The effect of the operation is to cause the tines 122 to engage the aggregate material within the form 22 and to agitate that aggregate material causing it to project from the surface and define a fuzzy or random rake pattern 125 in FIGS. 2 and 3. The cylinders are then actuated when the form 22 reaches its opposite end. Cylinders 66 and 68 thus retract the tines 122 from the material.

The panel then hardens in form 22. The form 22 is then removed to result in the panel 127 in FIG. 3.

Note that the adjacent bars 114, 116 define overlapping circular patterns when rotated on their respective shafts 80, 82. To preclude engagement of the bars 114, 116 and to preclude interference thereof, they are mounted on their respective shafts 80, 82 so that upon rotation, they will be out of phase. In this manner, the bars 114, 116 may overlap in their travel without interference.

Of course, the aggregate that is employed, the bonding hardenable material that is employed, the size and shape of the form, the size and shape of the tines, the number of tines and the spacing of the tines may all be varied while still being within the scope and meaning of the invention. Also, the forms or panel may be stationary and the assembly which holds the tines 122 may be mounted on rails to move over the form 22. Other alternative constructions may be utilized in the practice of the invention. Thus, the invention and all equivalents thereof are to be considered within the scope of the following claims.

What is claimed is:

1. Apparatus for mechanically forming a random rake finish in the surface of a cast material panel comprising, in combination:

a panel platform including means for transporting a panel in a linear direction along the platform;

vertical support members positioned on opposite sides of the panel platform so as to be on opposite sides of a panel on the platform moving in the linear direction;

a horizontal arm connected between said support members for positioning over the surface of a panel of poured cast material in a viscous fluid condition on the panel platform;

a plurality of tine support bars rotatably mounted in the arm, each bar mounted by means of a vertical shaft journaled in the arm and connected to the bar intermediate the ends of the bar;

a plurality of spaced tines projecting downwardly from each tine support bar;

means for projecting the tines into the poured cast material and for withdrawing the tines from the cast material, said means comprising adjustable piston means connecting each vertical support member to an end of the horizontal arm; and means for traversing the rotatably mounted tines relative to the surface of the panel of cast material, said means for traversing comprising a single drive shaft and a motor for said drive shaft supported on the horizontal arm for simultaneously engaging each vertical shaft by gear means, whereby the tine support bars are simultaneously rotated with the vertical shafts and the tines are movable in arcuate loops as the means for transporting a panel operates to move a panel on the platform in a linear direction under the arm with the tines projecting into the surface of the material when the material is fluid and viscous to thereby effect a random rake finish.

2. The apparatus of claim 1 including bevel gear means for driving a first tine support bar rotatably in a first direction and separate bevel gear means for simultaneously driving a second tine support bar rotatably in the opposite direction whereby the tine support bars and attached tines are driven in counter rotating directions by the single drive shaft to condition a surface.

3. The apparatus of claim 1 wherein the tines of adjacent tine support bars are mounted for overlapping movement in the surface of the panel of cast material.

* * * * *